United States Patent [19]

Gates

[11] 3,984,079

[45] Oct. 5, 1976

[54] CLAMPING LOCK FOR TIE ROD ENDS

[75] Inventor: H. Gordon Gates, Denver, Colo.

[73] Assignee: Gates & Sons, Inc., Denver, Colo.

[22] Filed: Aug. 5, 1974

[21] Appl. No.: 494,967

[52] U.S. Cl. ..... 249/42; 249/46; 249/190; 249/217; 249/219 R

[51] Int. Cl.[2] ..... E04G 17/06

[58] Field of Search ..... 269/126–128, 269/237–238; 249/40–46, 213–214, 216–217, 219 R, 219 W; 24/263 DL, 248 L, 248 B, 248 CR, 249 PL, 249 DD, 249 PP, 249 LL

[56] References Cited

UNITED STATES PATENTS

| | | | |
|---|---|---|---|
| 1,509,022 | 9/1924 | Noble | 24/249 LS |
| 1,755,572 | 4/1930 | Church | 24/263 DL |
| 2,190,748 | 2/1940 | Williams | 249/42 |
| 2,217,072 | 10/1940 | Nixon | 24/263 DL |
| 2,297,899 | 10/1942 | Krueger | 249/196 |
| 2,324,184 | 7/1943 | Wyman | 24/263 DL |
| 3,529,800 | 9/1970 | Gates | 249/213 |
| 3,633,867 | 1/1972 | Eriksson | 249/42 |
| 3,693,931 | 9/1972 | Holt | 249/46 |

FOREIGN PATENTS OR APPLICATIONS

| | | | |
|---|---|---|---|
| 1,000,733 | 2/1952 | France | 24/249 LL |

*Primary Examiner*—Francis S. Husar
*Assistant Examiner*—John McQuade
*Attorney, Agent, or Firm*—Sheridan, Ross, Fields & McIntosh

[57] ABSTRACT

There is provided an improved clamping lock for tie rod ends in form structures for settable casting compositions, e.g., concrete casting forms, which lock is characterized by means for attaching it to the form structure, and a pair of jaws shaped for mating coaction with the outer end of a tie rod end whereby relative axial movement of the lock with respect to the tie rod end is prevented and the form structure is correspondingly held against movement toward or away from an opposite form structure.

11 Claims, 15 Drawing Figures

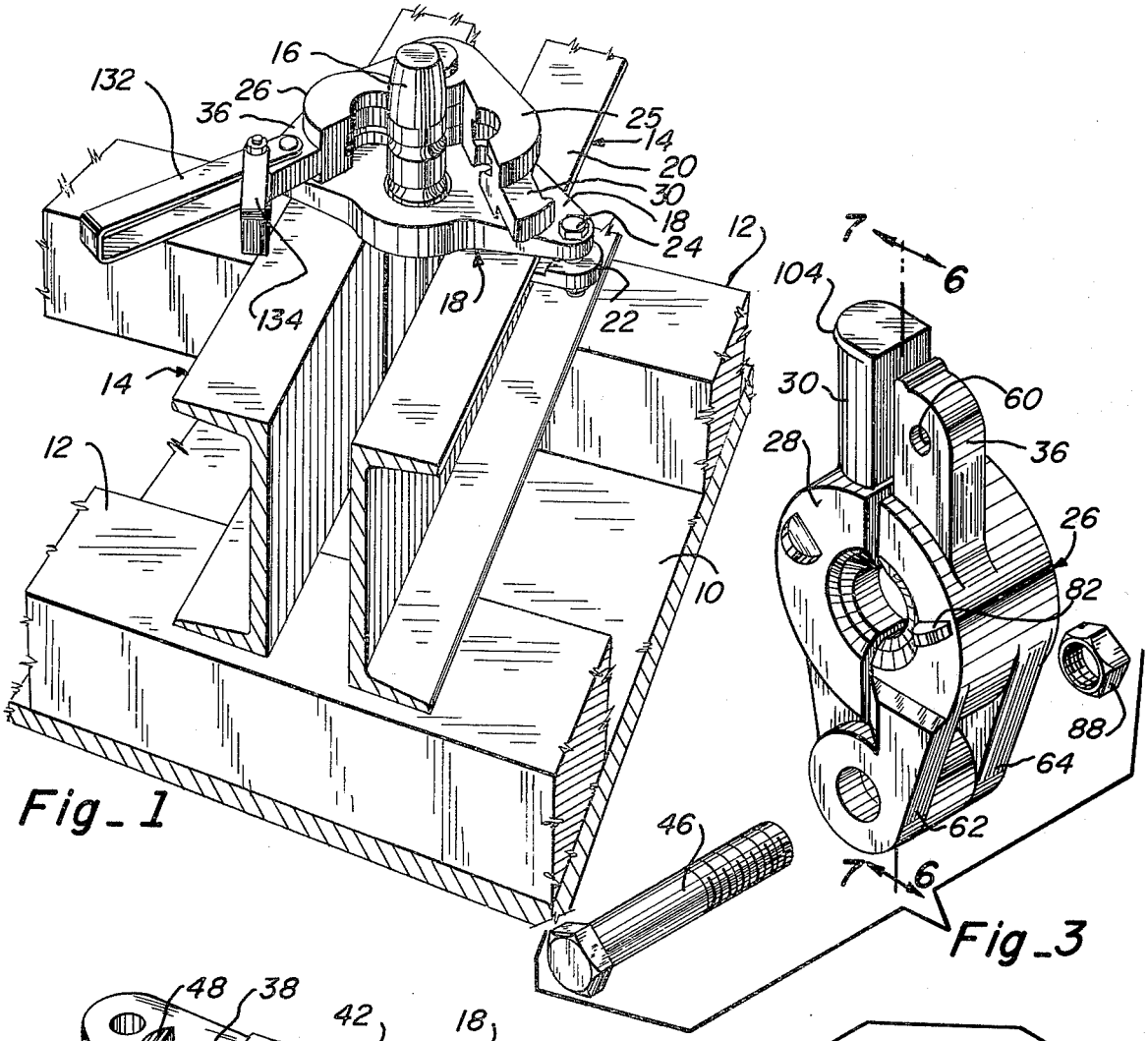
Fig_1
Fig_3
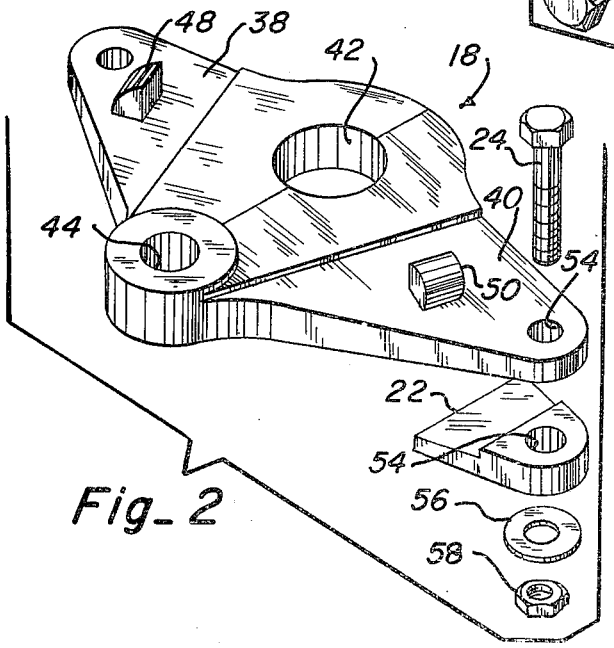
Fig_2
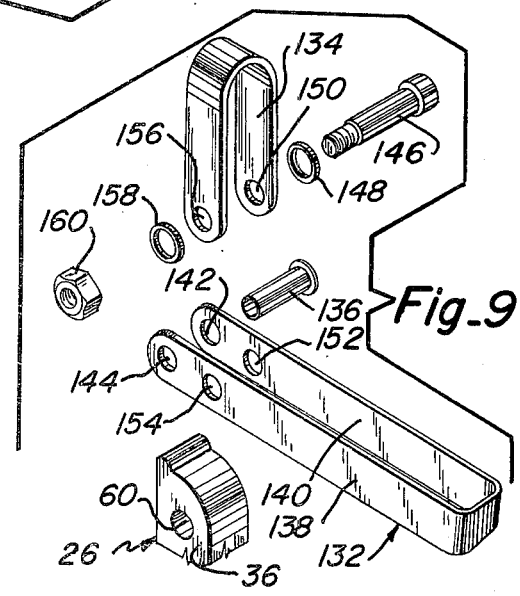
Fig_9

CLAMPING LOCK FOR TIE ROD ENDS

RELATED DOCUMENT

This application is related to my disclosure document No. 033716 filed July 12, 1974.

BACKGROUND OF THE INVENTION AND PRIOR ART

Heavy forms for vertical wall concrete castings in the past have generally been built with a combination of wood and steel or in some cases, where large amounts of repeat usage can be expected, on all steel form. In either case, the forms are most generally backed up vertically or in some cases horizontally with two heavier steel channels or wales, spaced on between 2 to 5 foot centers. As the channels are placed on the back of the form, they are spaced about 1-½to 2 inches apart to permit a heavy steel bolt or bolt-type of form tie to pass through the one form, through the zone that will become the concrete wall, and into and through the opposite form. In first constructing a heavy duty form, a plywood or steel facing is prepared that will be the confronting surface against the concrete. If plywood is used, and in most cases such plywood is ¾ of an inch thick, it is generally backed up or reinforced with fir 4 × 4's or 4 × 6's on 12 inch centers. If a steel form face is used, in most cases 3/16 inch thick, it is most generally backed up with steel angles about 3 inches by 3 inches or light 3 or 4 inch steel channels, also on about 12 inch centers. The heavy steel stiff back channels or wales are then secured in place as before mentioned on two, three, four or five foot centers, depending on the tie spacing that is desired. The rate at which the concrete is to be placed and the height of the wall also helps to govern the tie spacing. As previously stated, the channels are spaced about 1½ to 2 inches apart to permit a heavy steel bolt or bolt-type of form tie to pass between the forms from one side through the concrete zone and then through the opposite form on the other side.

In the past the bolt or tie has been designed with a standard thread or a coarse Acme thread, and secured in place with a large thick plate washer resting against the back of the two spaced steel channels or wales on the backside of each of the wall forms. Then, a nut is run down over the threads on each end of the tie to achieve the proper spacing for the wall thickness desired. With this type of form construction, there has never been a satisfactory provision for properly spacing and spreading the forms internally. Most of the ties used in the past in heavy concrete forming have been of the bolt design with a removable nut on each end. Because of the inability to strut the form panels apart, certain types of wall forming can create a problem in proper spacing. One good example is that of a battered wall where one of the forms is standing vertically, but the other form is tilted. Consider, for example, a wall that at the bottom is 30 inches in width and at the top of a 20 foot wall is only 12 inches in width. With this type of wall and a heavy form that will weigh often in excess of 10 pounds per square foot, there is a definite problem of the tilted form tending to fall against the face of the vertical wall form. Ties with a spreader or for a spacer have been used to hold both forms in the proper position. However, the spreaders or spacers may need to be sacrificed or, if removed, require plugging. Still a further problem encountered in this type of tie is that the installer can tighten the nut on one tie tighter than that on another, and then further down the wall, be looser than another, causing the wall to be wavy and for some of the ties to be overloaded and some ties not carrying any or very little load. This can also be dangerous and contribute to or cause a wall failure which in the industry is known as a "break out".

The present invention solves the problems indicated above and provides a tie and a form lock that can be used with any type of conventional gang form presently being marketed or built by the contractor, or for a form design utilizing the basic concept of a facing material or either wood or steel against the concrete. This in turn is backed up with either wood or steel preferably running horizontally. Then vertically, this assembly is backed with heavy steel channels on two to four or five foot centers running from the bottom to the top of the form and acting as a strong back and the main member to which the locks of the present invention are attached to receive the pressure of the wet concrete. These channels or wales are usually applied in pairs and spaced about two inches apart. It is to these vertical spaced apart channel members or wales that the locks of the present invention are applied on a prescribed spacing not to exceed about five feet by five feet.

BRIEF STATEMENT OF THE INVENTION

Briefly stated the present invention is in a clamping lock for a tie rod end in a settable casting composition form structure which comprises in combination a base plate having a tie rod end receiving bore extending therethrough and meand for fastening the base plate to the casting form structure, particularly, the wales. A pair of jaws are pivotally anchored on the base plate and selectively movable between an open position and a closed position about the tie rod end. Means are provided which coact between jaws when closed and the tie rod end for preventing axial movement of the jaws with respect to the tie rod end. Means are also provided for releasably locking the jaws in the closed position.

In a more specific embodiment of the present invention, the jaw confronting surface of the base plate uniformly decreases in thickness bilaterally from a line corresponding to the parting line of the jaws when closed to exert a wedging effect on the jaws in closing and a quick release effect in opening. In still more specific embodiments, the respective surfaces of the jaws in confronting relation with the base plate so uniformly sloped may also oppositely uniformly increase in thickness in a direction away from the parting line of the jaws when closed Generally this slope is less than 10° and preferably about 5°.

The present invention is also in a concrete form system including sheathing, studs, wales and tie rods wherein the improvement includes in combination a tie rod end having one end internally threaded for threaded engagement with a tie rod and an outer end extending beyond the wales and a tie rod end clamping lock as above described.

BRIEF DESCRIPTION OF THE DRAWING

The invention will be better understood by having reference to the annexed drawings wherein:

FIG. 1 is a perspective view showing a portion of a concrete casting form including sheathing, 4 × 4 studs, and 2 × 4 channel beams as wales with a tie rod end projecting therebetween and a clamping lock of the present invention opened and about to be applied to the tie rod end.

FIG. 2 is a perspective top view of a base plate and showing in exploded relation therewith clamping means for holding the base plate to a wale.

FIG. 3 is a perspective view of a pair of jaws in closed relation and showing in exploded relation therewith a pin for securing the jaws to the base plate such as that shown in FIG. 2.

FIG. 9 is an exploded view of a releasable locking means for holding the jaws in closed position.

DETAILED DESCRIPTION OF THE DRAWINGS

Figure 4:
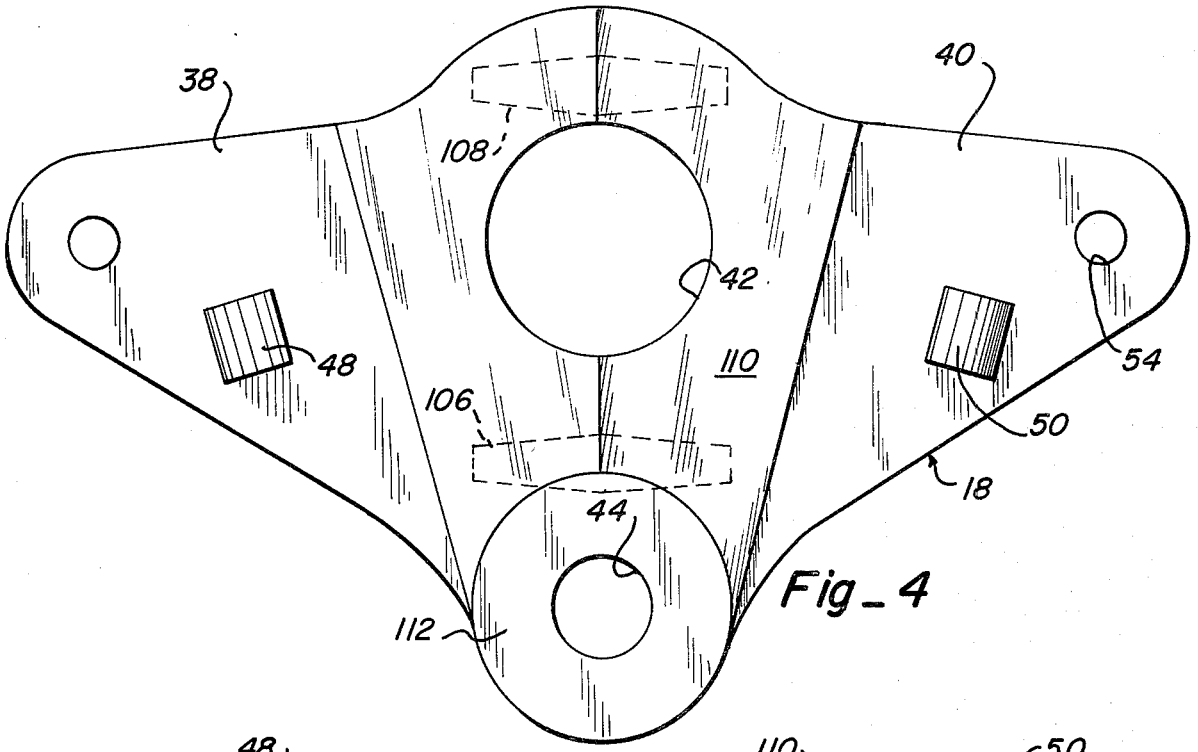
FIG. 4 is a top plan view of the base plate shown in FIG. 2.

Referring now more particularly to FIG. 1, there is here shown in perspective a portion of a casting composition form structure including a face material of either wood or steel such as sheathing 10 the opposite face of which not shown in FIG. 1 is intended to be in contact with wet concrete for forming the latter during hardening. Behind the sheathing 10 and generally on 12-inch centers there are provided studs 12 which are conveniently formed of 4 × 4 pine wood. Behind the studs 12 there are conveniently provided steel channels or wales 14 in back-to-back relation and spaced apart from 1 to 2 inches to permit a tie rod end 16 to extend therebetween. A base plate 18 is conveniently clamped to the upstanding flange 20 of the channel beam 14 by any suitable means such as a clamp member 22 secured thereto by a bolt 24 extending through the base plate 18 and holding the clamping member 22 tightly against the inner surface of the flange 20 by means of a nut not shown in FIG. 1. The opposite side of the base plate 18 is also similarly clamped to the opposite channel member 14 but not visible in FIG. 1. The jaws 26 and 28 are shown in their open position prior to clamping about the tie rod end 16. The jaw member 28 is provided with a projecting lug 30 over which a strap 134 may be looped when the jaws are closed, and tight locking effected by means of the lever handle 132 pivotally attached to a projecting lug 36 extending from jaw 26.

FIG. 1 shows only a single tie rod end and lock therefor in a fragmentay portion of a concrete casting form structure for illustrative purposes only. It will be understood that the tie rod ends will project from either side of the completed form which includes a member opposite to that shown in FIG. 1 and through which the tie rod end on the opposite side projects in a like but opposite manner. An entire form includes a plurality of tie rods extending through both sides of forming structures in the manner indicated in FIG. 1 and on centers which may be anywhere from 3 to 5 feet. Thus, areas of 9 square feet up to 25 square feet may be accommodated by structures built up in the manner indicated. Casting form structures including sheathing, studs, wales and tie rods are well known and the novel features of the present invention include a modification of the tie rod end and a clamping lock therefor. The balance of the forming structure exclusive of the tie rod ends as herein modified, and the clamping locks is conventional.

In a preferred embodiment, the base plate as shown in perspective in FIG. 2 is of generally bat-like or delta shape and includes a left wing portion 38 for overlying one channel of a wale and a right wing portion 40 for overlying an opposite channel member of a wale. The base is provided with a bore 42 dimensioned to receive therethrough the outer extremity of a tie rod end such as tie rod end 16. The fit between the bore 42 and the tie rod end 16 is reasonably loose so that the base plate may be easily fitted thereover. The base plate is also bored as at 44 to accept a pin 46 (FIG. 3) for pivotally securing the jaws 26 and 28 thereto. In a preferred embodiment the wing portion 38 is provided with a left jaw stop 48 and the right wing portion 40 is provided with a right jaw stop 50. The purpose of the stops is simply to limit the extent of opening of the jaws and preserve compactness and ease in handling of the unit.

In order to secure the base plate 18 to the wale 14 (FIG. 1) there is conveniently provided and shown in exploded relation in FIG. 2 a clamping member 22 adapted to fit behind the flange 20 of the wale 14. To effect the clamping a bolt 24 extends through a bore 52 in the wing 40 through a corresponding bore 54 in the clamping member 22, a washer 56 and a nut 58.

The opposite left wing 38 is also provided with a similar clamping structure, but not shown in FIG. 2.

Figure 6:
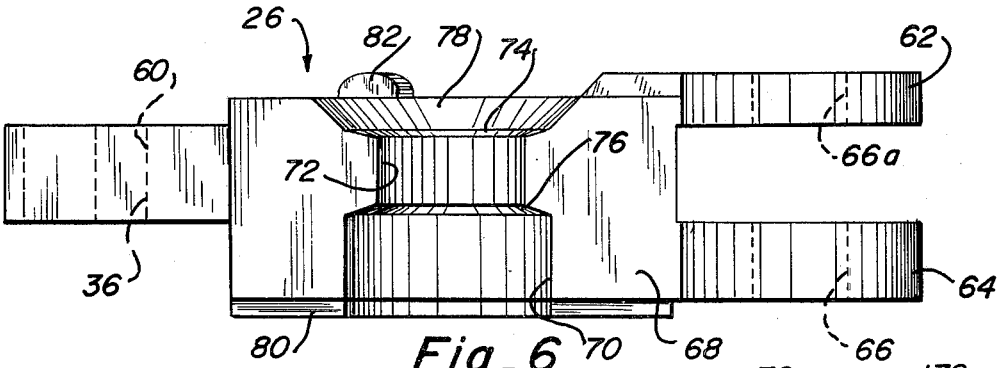
FIG. 6 is an orthogonal front view of one of the jaws shown in FIG. 3 as it appears in the plane indicated by the line 6—6.
Figure 7A:
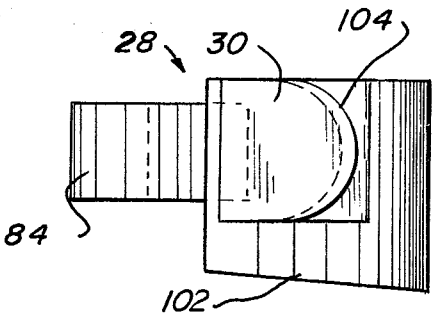
FIG. 7*a* is an orthogonal end view of the opposite jaw.
Figure 7:
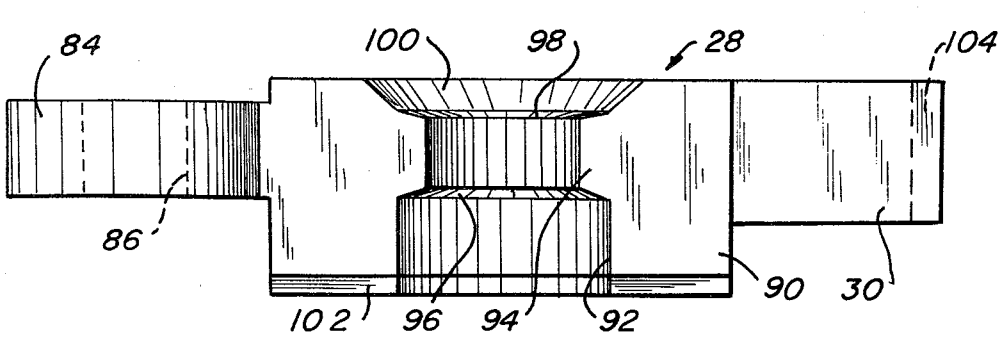
FIG. 7 is an orthogonal front view of the opposite jaw member shown in FIG. 3 as it appears in the plane indicated by the line 7—7 in FIG. 3.

FIGS. 3, 6 and 7 show in greater detail the clamping of the jaws of a preferred embodiment of the present invention. The jaw member 26 is also shown in FIG. 6, and the jaw member 28 is also shown in FIG. 7. Referring now to FIGS. 3 and 6, the right hand jaw member 26 as shown in FIG. 3 includes the projecting lug 36 having a bore 60 extending therethrough for purposes as will hereinafter be explained. The opposite end of the jaw 26 is provided with a pair of spaced pivot eyes 62 and 64 having a pivot bore 66, 66a extending therethrough. The pivot eye portions 62 and 64 are integral with and extend from a central jaw portion 68 of generally semi-circular configuration. The central jaw portion includes a pilot bore portion 70 dimensioned to receive the full diameter of the tie rod end. An inwardly projecting flange or neck 72 is provided having a radius of curvature less than the measured diameter of the tie rod end and adapted as hereinafter more particularly described to seat in a corresponding recess in the tie rod end. The inwardly projecting flange portion 72 is conveniently provided with tapered shoulder portions 74 and 76 for seating against corresponding shoulder portions in the tie rod end as later described. In a preferred embodiment, the shoulder portion 74 is a champfer of about 20°. The shoulder portion 76 is a champfer of approximately 10°. The flange portion 72 is of generally semi-circular configuration.

A counter sink portion 78 is conveniently provided on the outer face of the jaw member 26 having an angle of approximately 45° with respect to the vertical.

Figure 6A:
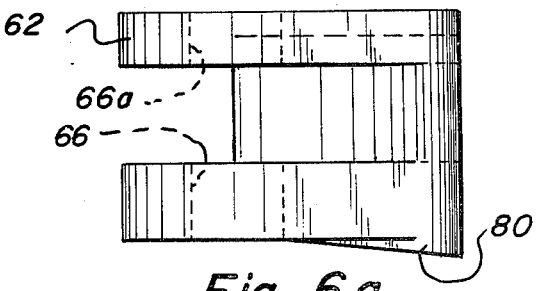
FIG. 6*a* is an orthogonal end view of one of the jaws shown in FIG. 3.

As best shown in FIG. 6 and 6*a*, the lower face of the jaw 26 which is in confronting relation with the base plate 18 is, in a preferred embodiment, provided with a wedge surface 80 which is sloped at an angle of about 5° to the plane of the lower surface of the jaw 26. The purpose of the wedge 80 is to exert a tightening effect on closing the jaw, and a quick release effect when opening the jaw. The upper or outer surface of the jaw 26 may be provided with a hammer hit point 82 raised out of the plane of the upper surface. Although the internal surfaces of the pilot bore, the flange, the shoulder portions and the counter sink portions may be fully semi-circular, the parting plane may be shaved back a few thousandths, for example, ten thousandths on a 1.5 inch radius jaw member, to provide some clearance between the jaws when closed for better wedging effect and clamping effect.

Referring now more particularly to FIGS. 3 and 7, the opposite jaw member 28 includes a pivot eye portion 84 having a bore 86 extending therethrough and of the same diameter and on the same center line as the bore 66–66*a* in the jaw member 26. These members 26 and 28 pivot, therefore, about the pin 46 which extends also through the bore 44 and is secured to the base plate 18 by the nut 28 (FIG. 3). The jaw 28 is provided with a projecting or lug portion 30, and a central generally semi-circular portion 90. In the same manner but mirror image manner as in the jaw portion 26, the jaw portion 28 is provided with a pilot bore 92 and a radially inwardly extending flange 94 having shoulder portions 96 and 98. There is also provided a counter sink portion 100. The shoulder portion 96 is conveniently champfered at an angle of approximately 20° to the horizontal, and the shoulder portion 98 is conveniently champfered at approximately 10° to the horizontal. The counter sink portion is champfered at 45°. As in the case of the jaw portion 26, while the pilot portion 92 and the flange portion 94 as well as the shoulder portions 96 and 98 and the counter sink 100 may be semi-circular in configuration, in practical embodiments, the parting plane of jaws 26 and 28 may be recessed also into the jaw 28 a distance of 0.000 inches to 0.010 inches. As with the jaw member 26, the lower surface of the jaw member 28 which is in confronting relation with the base plate 18, may be provided with a wedge portion 102 slopping downwardly and outwardly at about 5° to the horizontal as shown in FIG. 7*a*.

The projecting lug 30 is conveniently provided with a lip 104 which serves as a retainer for the locking member hereinafter more particularly described.

Figure 5:
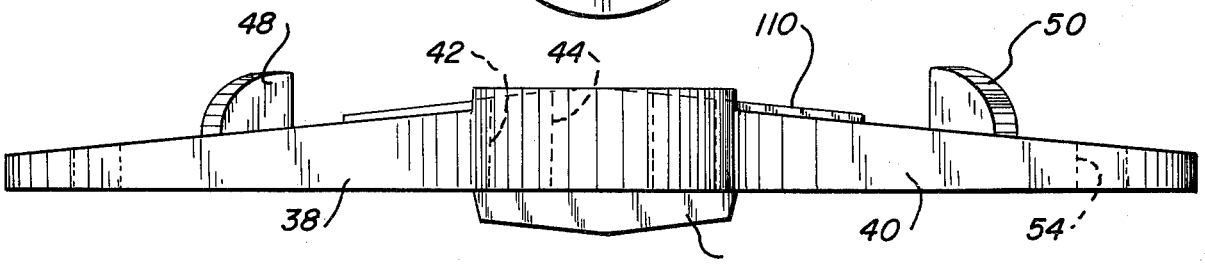
FIG. 5 is a front elevation of the base plate shown in FIG. 4.

FIGS. 4 and 5 show top and side elevations of a generally delta shaped base plate useful in accordance with the present invention, and show in more detail the structure illustrated in FIG. 2. In order to aid in locating the base plate with respect to the wales, there are provided two small spreader bars or struts 106 and 108 spaced apart as shown in FIG. 4 and centrally located on the lower surface of the base plate 18 which is in confronting relation with the wales. This strutting is important so that when the heavy tie is passed through the lock and between the channels, and out through the form, the channels cannot pinch together and thus prevent pass through action. The front side of the base plate is provided at the center with a bilaterally (from the vertical center line as shown in FIG. 4) extending downwardly and outwardly sloping area. In the preferred embodiments of the present invention, this taper is valuable in facilitating the opening of the lock. Each of the jaw members 26 and 28 will open in the form of a V and move back and off of the sloped area 110 to either side to permit immediate freeing from the concrete load which the tie and lock has been carrying and from the form tie. The bottom portion 112 of the base plate 18 as shown in FIG. 4 is provided with a bore 44 through which the pin 46 passes and becomes a pivot point for the jaws 26 and 28. In a preferred embodiment of the present invention the base plate is of substantial weight and design to hold in excess of 35,000 pounds of concentrated load of wet concrete within the form. This provides a substantial safety factor in a system which is designed to be worked on a load of from 24,000 to 25,000 pounds and when the tie rods are spaced on not more than 5 × 5 spacing. As previously indicated, on each side of the base plate there are provided bumper points 48 and 50 integrally cast with the base plate and for the purpose of preventing the jaws 26 and 28 from opening more than about 30° on either side. This extent of opening will maintain the locking mechanism in a working position to immediately move forward into place and grasp the heavy tie rod end in the proper location when the tie is inserted. The bilateral slope of the central portion 110 is less than 10° and desirably about 5°.

Figure 8:
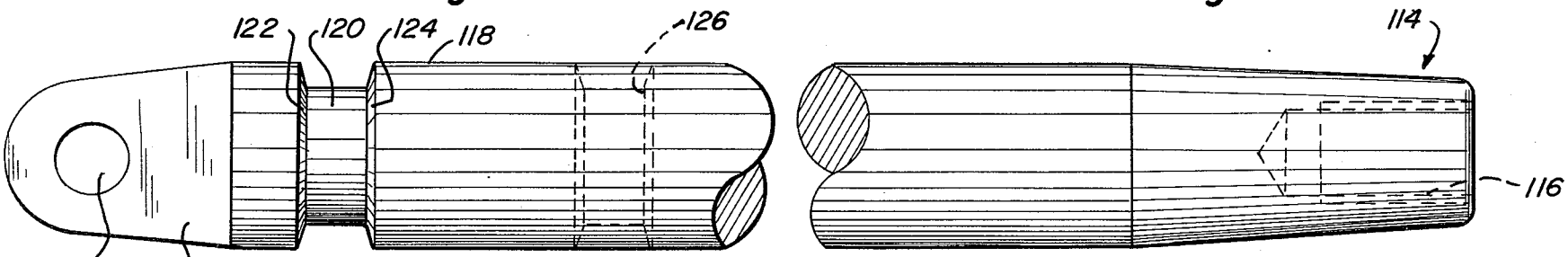
FIG. 8 is a plan view of a tie rod end in a form useful with the clamping locks of the present invention.

FIG. 8 is a plan view of a typical tie rod end modified for use in accordance with the present invention. Except for the modification of the distal extremity (the end of the tie rod end which extends beyond the wales) these tie rod ends are of conventional design and known use. As shown in FIG. 8, the proximal extremity 114 of the tie rod end is desirably tapered slightly, for example 3° 30′ over about 2.5 inches in length, and is drilled and threaded as at 116 to accept the threads of a conventional tie rod normally formed of steel and frequently adapted to remain in the concrete. The tie rod end as the structure in FIG. 8 is called, threadedly engages a steel tie rod, for example, at 116 extends beyond the face of the concrete to be cast, through the sheathing and the studs, and through the rails. The distal extremity in the conventional tie rod end is usually threaded to receive a bolt and washer, and, as indicated above, no means are therefore provided to prevent the form portion from moving to the right relative to the tie rod end as shown in FIG. 8 toward the other form wall.

As modified in the present invention, the distal end 118 of the tie rod end is conveniently provided with at least one circumferential recess 120 which is designed and configured for mating coaction with the shoulder portions 74, 76, 96 and 98 of the jaws 26 and 28, respectively when closed. The radially extending side walls of the recess 120 may be perpendicular to the axis of the tie rod end, or tapered as shown in FIG. 8. The taper of the side wall or abutment 122 corresponds and mates with the sloped shoulder portion 76 of the jaw member 26 and the shoulder portion 98 of the jaw member 28 when jaws 26 and 28 are closed about the distal end 118 of the tie rod end of FIG. 8. In like manner the shoulder or abutment portion 124 is desirably correspondingly tapered to coact with the shoulder 74 of the jaw 26 and shoulder 96 of the jaw 28. The wedging effect occasioned by the juncture of the shoulders 74 and 76 and 96 and 98 with the abutments 122 and 124, for example, provides a wedging effect for tight locking retention of the tie rod end. The distal extremity 118 may also be provided with a second recess 126 shown in dotted lines in FIG. 8. In such event the jaw members 26 and 28 would be correspondingly configured to provide a pair of annular flanges formed from the flanges 72 and 94, for example, and their similarly configured flanges when the jaws 26 and 28 are closed. Any number of recesses and flanges may be provided, although for most purposes one or two such recesses and locking flanges will be found satisfactory.

In a preferred embodiment, the flange formed from the flange portions 94 and 72 of the jaw members 28 and 26, respectively, desirably has a width of about 1/16 of an inch less than the width of the recess 120 in the distal end 118 of the tie rod end of FIG. 8. Such a clearance will allow only 1/16 of an inch of movement of the form when the tie is securely held in place, but will make for easy release and pickup for dirt or grit that might otherwise be trapped inside the tooth or gripping area.

For most purposes for a 1-⅜ inch diameter tie rod end the width of the recess is approximately ½ inch and the corresponding flange approximately 7/16 of an inch. As previously indicated, as many grooves as desired may be provided at the distal end 118. This allows flexibility on each tie end and takes care of wales that may be anywhere from 4 to 8 inches in width.

The extreme left end of the tie rod end shown in FIG. 8 is suitably configured for ease in removal and reclaiming of the tie rod end after the casting has hardened. As shown in FIG. 8, an eye 128 carried in a terminal projection 130 which is integral with the tie rod end may be provided to permit the insertion of a pin and the counterclockwise rotation of the tie end to separate it from the threaded end of the tie rod remaining in the concrete cast structure. The eye 128 also provides a means for attaching a tool to assist in pulling the tie rod end out of the forming structure after the base plate and locking assembly has been removed therefrom. Any other configuration for the end exposed beyond the clamping lock of the present invention may be employed, and many such forms are available in the field at the present time. These include ends shaped for use with an impact wrench or a cresent wrench, and the like.

FIG. 9 illustrates a preferred mode of locking the jaws 26 and 28 together. There is here shown in exploded relation a lever handle 132 and a U-shaped strap 134 which is dimensioned and configured for throwing over the lug 30 of the jaw member 28 and for retention behind the lip 104. As shown in FIG. 9, a fragment of the projecting portion 36 of the jaw 26 is provided with a bore 60 to accept a rivet 136 which extends through the arms 138 and 140 at pivot holes 142 and 144. The spacing between the arms 138 and 140 is such as to accommodate therebetween the width of the projecting portion 36 of the jaw 26. After insertion of the rivet through the pivot holes 142 and 144 and the bore 60, the rivet 136 is set in a known manner.

The U-shaped strap 134 is pivotally mounted on the lever 132 intermediate the extremeties thereof and preferably closely adjacent the axis of rotation of the lever 132 about the rivet 136. Attachment of the U-shaped strap 134 is conveniently achieved by means of a pivot pin 146 extending through a washer 148, the pivot hole 150 in the distal end of one leg of the U-shaped strap 134, the pivot hole 152 in the arm 138, the pivot hole 154 in the arm 140, the pivot hole 156 in the distal end of the opposite arm of the U-shaped strap 134, the washer 158, secured in position by means of nut 160.

In use, then, the strap 134 is thrown over the lug 30 of the jaw member 28 and the lever handle 132 rotated about the rivet 136 "past center" thereby effecting a locking of the jaws 26 and 28 together in a manner which cannot be thwarted by the weight of wet concrete poured into a form.

With the throw over lever type structures, such as shown in FIG. 9, the handle portions 132, for example, may be coated with a bright colored paint. It is quite easy then to determine by the position of the handle whether all of the clamping locks have been properly closed before the pour is started.

Figure 12:
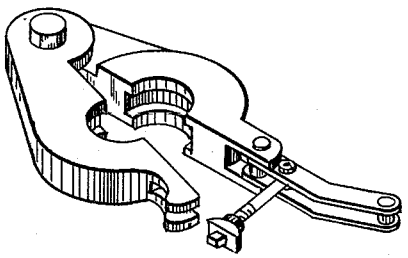
FIGS. 10, 11 and 12 are illustrations of other locking devices for holding the jaws in closed position, and showing only the jaws and closing locks therefor.
Figure 11:
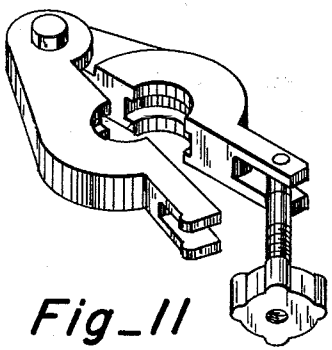
Figure 10:
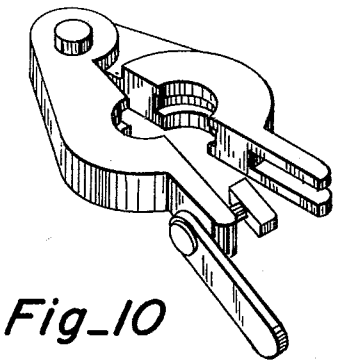

Any of a number of means of locking the jaws together may be provided. That illustrated in FIG. 9 is preferred because of its simplicity and ease of operation. Those locking means which include a member pivotally secured to the projection from one jaw and dimensioned and configured for holding coaction with the projection or projections from the other jaw are preferred. In certain embodiments the other jaw may be slit on the projection to accept a swing bolt therebetween threaded to accept a nut or wing nut which can be tightened down against the projection to hold the two members together. Instead of a threaded member, the swing bolt may have affixed to its outer extremity a butterfly locking member for overlying locking engagement with the projecting member. A camming action would assure closure of the butterfly member when rotated with a lever. Examples of these other forms of locks are illustrated in FIGS. 10, 11 and 12, and in view of the preceding discussion are believed fully self-explanatory. FIGS. 10, 11 and 12 omit the base and illustrate merely various locking means for holding the jaws closed.

Figure 13:
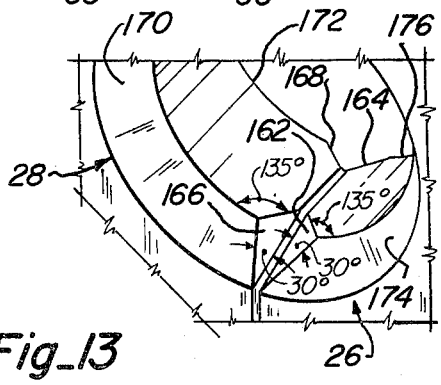
FIG. 13 is a fragmentary perspective view of the jaws in the closed position showing the opposing corners of the locking flanges or teeth chamfered.

FIG. 13 shows an improvement on the structure shown in FIGS. 1, 2 and 3. It has now been found desirable to rake back the four corners of the inwardly projecting flange portions 72 and 94, respectively. Thus, the front and back corners 162 and 164 of jaw member 26 and the opposing front and back corners 166 and 168 are filed off or otherwise removed, or champfered on the bottom edge of the jaws 26 and 28 that enter the recess 120 of the tie rod end (FIG. 8) first on closing the jaws, and leave the recess 120 last on opening the jaws. By cutting off the corners, it aids in closing the jaws around the tie rod end, and lets the final stress off the lock better when it is opened. Thus, the best mode of carrying out my invention is the lock structure as shown in FIGS. 1, 2 and 3 as modified by FIG. 13. The breaking of the corners as at 162, 164, 166 and 168 is at 135° to front and back faces 170 and 172, respectively, and 30° to the vertical on jaw 28. In like, but opposite, manner corners 162 and 164 of jaw 26 are broken at 135° to the front and back faces 174 and 176, respectively, and 30° to the vertical.

I claim:

1. A clamping lock for use with a tie rod end in a settable casting combination form structure, said clamping lock comprising:

a. a base plate having a tie rod end receiving bore extending therethrough and a jaw confronting surface;

b. means on said base plate for fastening said base plate to said casting form structure;

c. a pair of jaws pivotally anchored on said base plate and selectively movable between an open position and a closed position about the tie rod end, said jaw confronting surface of the base plate uniformly decreasing in thickness bilaterally from a line corresponding to the parting line of the jaws when closed to exert a wedging effect on the jaws in closing and a quick release effect in opening;

d. means on said jaws for coacting between the jaws when closed and the tie rod for preventing axial movement of the jaws with respect to the tie rod end; and e. means on said jaws for releasably locking said jaws in the closed position.

2. A clamping lock in acordance with claim 1 wherein the respective surfaces of the jaws in confronting relation with the base plate uniformly increase in thickness in a direction away from the parting line of the jaws when closed.

3. A clamping lock in accordance with claim 1 in which the slope of the decrease in thickness is less than 10°.

4. A clamping lock in accordance with claim 3 in which the slope is about 5°.

5. A clamping lock in accordance with claim 2 in which the slope of the increase in thickness is less than 10°.

6. A clamping lock in accordance with claim 5 in which the slope of the increase in thickness is about 5°.

7. In a concrete forming system including sheathing, studs, wales and tie rods, the improvement which comprises in combination:

a. a tie rod end having one end internally threaded for threaded engagement with a tie rod, and an outer end extending beyond said wales;

b. A tie rod end clamping lock comprising in combination:

1. a base plate having a tie rod end receiving bore extending therethrough and a jaw confronting surface;

2. means on the base plate for fastening said base plate to a wale member;

3. a pair of jaws pivotally anchored on said base plate and selectively movable between an open position and a closed position about the outer end of said tie rod end, said jaws forming an annulus when closed and having a surface cooperating with said jaw confronting surface to exert a wedging effect on the jaws in closing and a quick release effect in opening;

4. at least one circumferential groove adjacent said outer end coacting with said annulus of said jaws when closed for restricting axial movement of the jaws with respect to said tie rod end; and 5. means on said jaws for releasably locking said jaws in the closed position about the outer end of said tie rod end.

8. A clamping lock in accordance with claim 7 wherein the jaws each include a projecting member for coaction with said releasable locking means, said projecting members having confronting surfaces which define a recess out of the parting plane of said jaws when closed to provide a pry tool receiving crotch to aid in opening the jaws after use.

9. A clamping lock in accordance with claim 7 wherein the base also includes stop means for limiting the extent of opening of the jaws.

10. A clamping lock in accordance with claim 7 wherin the annulus is formed from inwardly projecting generally semicircular flange portions from each of said jaws.

11. A clamping lock in accordance with claim 10 wherein the front and back corners of the inwardly projecting flange portions first to enter the grooves in the tie rod end on closing the jaws are champfered.

* * * * *